United States Patent [19]

Goller et al.

[11] Patent Number: 4,827,739

[45] Date of Patent: May 9, 1989

[54] FLAT KNITTING MACHINE

[75] Inventors: Ernst Goller, Reutlingen; Franz Schmid, Bodelshausen; Hermann Schmodde, Albstadt, all of Fed. Rep. of Germany

[73] Assignee: H. Stoll GmbH & Co., Reutlingen, Fed. Rep. of Germany

[21] Appl. No.: 90,517

[22] Filed: Aug. 28, 1987

[30] Foreign Application Priority Data

Aug. 28, 1986 [DE] Fed. Rep. of Germany ..... 3629334

[51] Int. Cl.[4] ..... D04B 35/04

[52] U.S. Cl. ..... 66/64; 66/106; 66/121

[58] Field of Search ..... 66/121, 122, 123, 106, 66/64

[56] References Cited

U.S. PATENT DOCUMENTS

| | | | |
|---|---|---|---|
| 1,764,406 | 6/1930 | Hohmann | 66/121 |
| 4,713,948 | 12/1987 | Schmidt et al. | 66/121 |

FOREIGN PATENT DOCUMENTS

| | | | |
|---|---|---|---|
| 218817 | 3/1957 | Australia | 66/121 |
| 12490 | 2/1881 | Fed. Rep. of Germany | 66/121 |
| 202681 | 9/1958 | Fed. Rep. of Germany | 66/121 |
| 1410312 | 4/1969 | Fed. Rep. of Germany | 66/121 |
| 24311 | of 1894 | United Kingdom | 66/121 |

*Primary Examiner*—Ronald Feldbaum

*Attorney, Agent, or Firm*—Larson and Taylor

[57] ABSTRACT

By the use of special latch needles (21) whose latch (14) can take up two stable positions lying within the limits of its pivotal movement and out of which it can be moved only against the action of a spring, there is ensured, even in fast running flat knitting machines with a transfer mechanism and with stitch presser and/or stitch hold-down elements, and even during the formation of long, loose stitches and loops, reliable trapping of the yarn and manipulation of the stitches and loops by the knitting elements. (FIG. 2)

1 Claim, 5 Drawing Sheets

FLAT KNITTING MACHINE

DESCRIPTION

Figure 1:
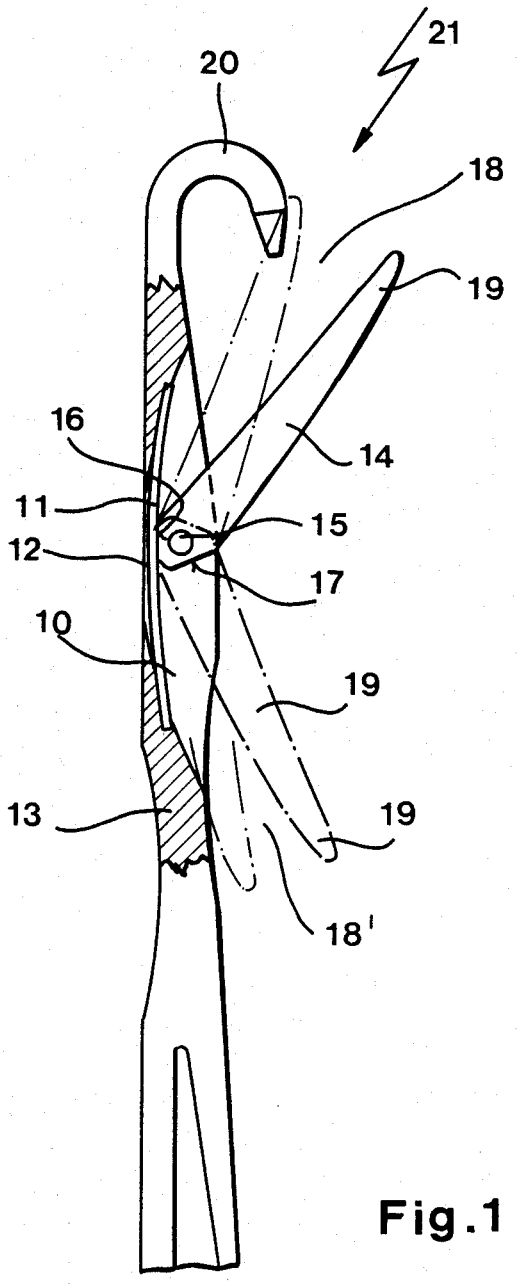

The invention relates to a flat knitting machine with a transfer device and with stitch presser and/or stitch hold-down elements.

The usual knitting take-down devices located beneath the needle beds of flat knitting machines have shown themselves to be disadvantageous in various ways. In the production of shaped pieces of knitting they produce unequal take-down tensions in the fabric if all regions of the fabric cannot be gripped at the same time by the take-down elements. Disadvantages also show themselves in the case of fabrics with designs through varying stitch formations, if for example a build up of loops is introduced, or also in knitting procedures to form wedge-shaped portions in the knitting. In order to avoid these known disadvantages, attempts have been made to replace the action of the conventional take-down devices completely or partly by the action of stitch pressers which are moved with the cam carriage of the flat knitting machine and extend down into the bed gap of the flat knitting machine, and by the action of stationary, barb-like stitch hold-down members in the bed gap. With these devices, the old stitches should be held down in the bed gap of the machine when the needles are raised to form new stitches or tucked loops or to transfer. These devices bring about a marked improvement since they act directly on the fabric hanging on the needles and thus effect a better equalisation of the tension in the stitch formations accumulated adjacent one another on the needles.

By stitch presser and/or stitch hold-down elements should be understood elements such as those disclosed, for example, in the specifications GB-PS No. 844 186, 10 53 477, GB-OS No. 21 20 684, DE-GM No. 80 19 179, DE-OS Nos. 30 13 145, 34 23 564 and 34 28 059.

Even with these arrangements it cannot be altogether avoided, especially at high knitting speeds, that a smaller tension is imposed on many stitches compared with others and thus inevitably a greater freedom of movement exists for these stitches, which in fast operating machines can lead to knitting faults, so that, especially with very long stitches, during transfer, the heads of stitches do not, or only partly, reach the hooks of the receiving needles and are split, or, during retraction of the transferring or knitting needle slide back wholly or partly over the opened needle latches into the needle hooks.

The aim which is the basis of the invention is to ensure that in these flat knitting machines with stitch presser and/or stitch retaining elements for holding down stitches in the bed gap, despite the lower stitch tensions which prevail, even in fast running machines a more reliable working of the yarn and manipulation of the stitches by the knitting elements is secured.

The problems set out is solved according to the invention in a flat knitting machine of the kind described in that it is provided with latch needles whose latches, in known manner, have two stable positions within their region of pivotal movement, one of which lies before the fully closed position and the other before the fully open position of the latch, and out of which the tongue can be pressed into the fully closed or the fully open position, in each case against the return force of a spring.

Through the use of such latch needles, which are known from hand knitting machines, in modern flat knitting machines, wherein the needle latch advantageously bears, with its end adjacent its pivot, against a rod-shaped spring located in the latch guide slot of the needle shaft and supported by its ends against the ends of the latch guide slot, and wherein the end of the latch has two flat regions which determine the two stable positions, it is ensured that, even in fast running machines and with a long stitch length setting, a reliable cooperation between the stitch heads and the loop heads and the latch needles is achieved even in the absence of the tension exerted on the formed stitches by a take-down device.

Upon the introduction of these known needles for the solution of the problem set out, one had to overcome the prejudice that these special latch needles would no longer be able to fulfill the function of taking up two stable pivot positions of the latch at high raising and lowering speeds, and that the stress due to the movement of the tongue imposed on the spring acting on the tongue would be too great to be sustained by a spring which would be relatively weak in relation to the size of the forces involved. Contrary to these prejudices, it has emerged that the latch needles can be equipped with sufficiently strong springs, which as well as ensuring the retention of the two stable positions mentioned by needle latches not contacted by the yarn, also ensure a sufficiently long stationary period for the needles.

With the known spring-latch needles from a hand knitting apparatus, no possibility of transfer was available. The use of needles with their latches in a partly open position for the reliable introduction of a stitch to be transfered into the hook of the receiving needle during the transfer procedure was nowhere described and had also not been applied.

The introduction of the special latch needles has proved especially advantageous in combination with moveable sinkers located between the latch needles in such a way that the sinkers of the two needle beds are located opposite one another and in a forward position, in which they form bridges spanning the bed gap, have projections which are in contact with one another so that no old stitch can move up out of the bed gap along the shafts of the rising needles. Here the sinkers constitute the stitch hold-down elements although the knitting machine can in addition be provided with a stitch presser.

There will be described in greater detail below, in conjunction with the accompanying drawings, an embodiment of a latch needle which is used and an embodiment of a double-bed flat knitting machine, without take-down, provided with the latch needles and with moveable sinkers.

Figure 2:
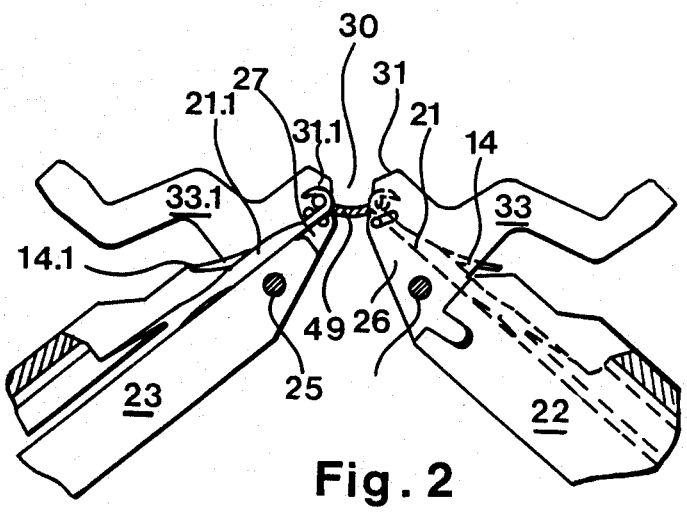

In detail there is shown in:

FIG. 1 a side view of the head region of a latch needle employed, partly in central longitudinal section;

FIG. 2 a partial cross-section through the two needle beds of a V-bed flat knitting machine fitted with latch needles and sinkers, in the region of the bed gap of the flat knitting machine;

FIGS. 3–9 views corrsponding to FIG. 2 with various relative positions of needles and sinkers in the course of the production of a double jersey fabric or during transfer.

The latch needle 21 shown in FIG. 1 has a spring rod 11 inserted in its latch slot 10, which extends over the needle aperture 12 and is supported by its ends on the needle shaft 13. The end of the latch 14 adjacent its pivot axis 15 abuts against the spring rod 11 and is provided at this end with two flat regions 16 and 17. These flat regions provide for the latch 14 within its pivot region two stable positions, which it can be moved out of only by bending the spring rod 11. In FIG. 1 the latch 14 is shown by a full line in one of these stable positions in which the flat region 16 abuts against the spring rod 11. In this stable position there remains a gap 18 between the spoon 19 of the latch and the needle head 20. The fully closed position of the latch 14 in which the latch spoon 19 abuts against the point of the needle head 20, and which is shown in FIG. 1 with a thin chain-dotted line, can be achieved by pressure on the latch spoon 19 against the return force of the spring rod 11 as, for example, is exerted by a stitch during knock-over. In the other stable position of the needle latch 14 in which the flat region 17 abuts against the spring rod 11, the latch 14 forms a relatively large gap 18' with the needle shaft 13. This second stable position is shown in FIG. 1 with a thick chain-dotted line. The fully open position of the latch needle 21 in which the latch 14 abuts against the end of the latch slot 10 is indicated with a thin chain-dotted line. The latch 14 can be pressed into this full end position against the return force of the spring rod 11 by a stitch sliding over the latch onto the needle shaft.

Figure 3:
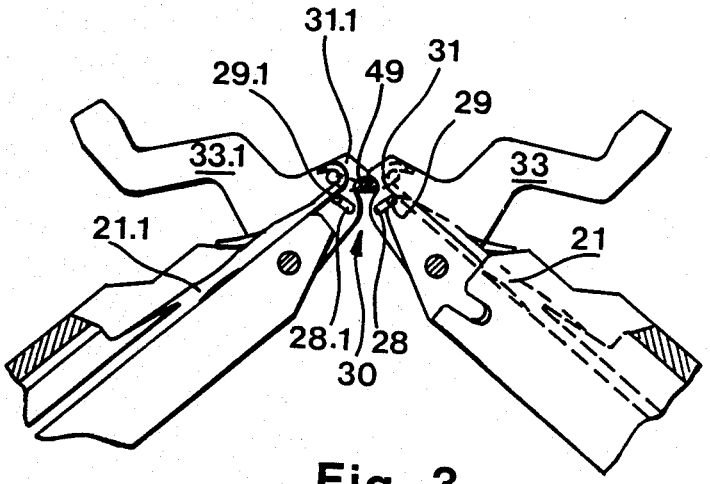
Figure 4:
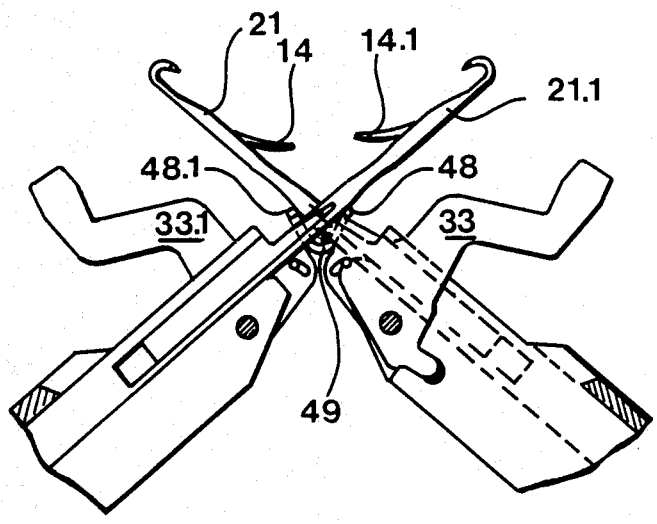

FIGS. 2 to 7 show a schematic cross-section through the bed gap region 30 of a V-bed flat knitting machine with a front needle bed 22 and a rear needle bed 23 which are equipped with needles 21 and 21.1 of the kind shown in FIG. 1 and with sinkers 33 and 33.1. The sinkers 33 or 33.1 of the front needle bed 22 or the rear needle bed 23 are in each case threaded onto a common pivot axle 24 or 25 together with stitch-forming projections 26 and 27. Each sinker has in addition an arcuate slot 28 or 28.1 in FIG. 3 through which in each case is led a wire 29 or 29.1 forming the stitch knock-over edge of the respective needle bed 22 or 23. The curved slot 28, 28.1 limits the pivotal movement of the sinkers 33, 33.1 about the pivot axles 24 or 25. Each sinker is provided with a projection 31 or 31.1 and the projections of two sinkers lying opposite one another can, as shown in FIG. 3, be brought into abutting relationship so that they form a bridge spanning the bed gap 30.

FIG. 2 shows a relative position of the needles 21, 21.1 in which an old stitch hangs in the head of each of the needles 21 and 21.1 and the old stitches are connected with one another by a connecting loop 49. The latches 14 and 14.1 of the needles 21 and 21.1 are located in their stable partly open position in which, as shown in FIG. 1, the flat region 17 of the latch 14 abuts against the spring rod 11.

FIG. 3 shows the position of the knitting elements before the start of the needle rise. The sinkers 33 and 33.1 of the two needle beds 22 and 23 are pivoted into their forward position in which their projections 31 and 31.1 abut one another so that during the following rise of the needles 21 or 21.1 to the position visible in FIG. 4, the old stitch held by the needle in each case cannot slide up out of the bed gap 30. During the rise of the needles 21, 21.1 into the position visible in FIG. 4, the old stitches 48 and 48.1 slide over the tongues 14, 14.1 down onto the needle shaft after which the latches 14, 14.1 spring back into their stable partly open position.

Figure 5:
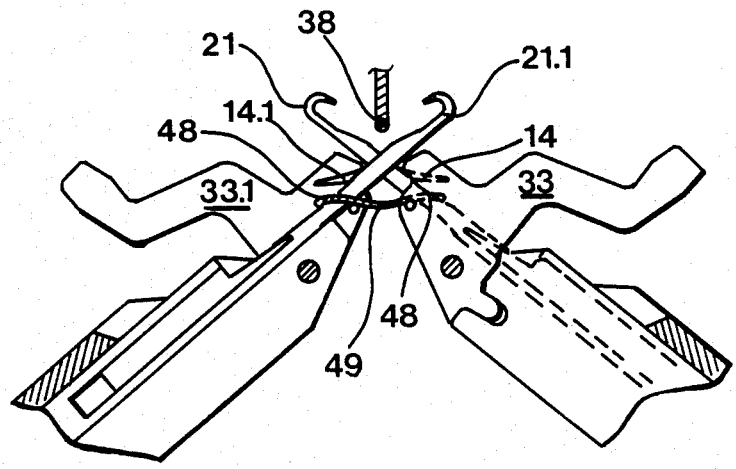
Figure 6:
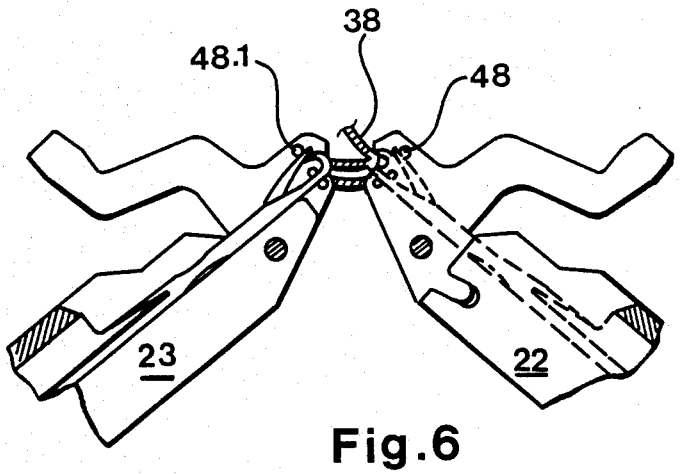
Figure 7:
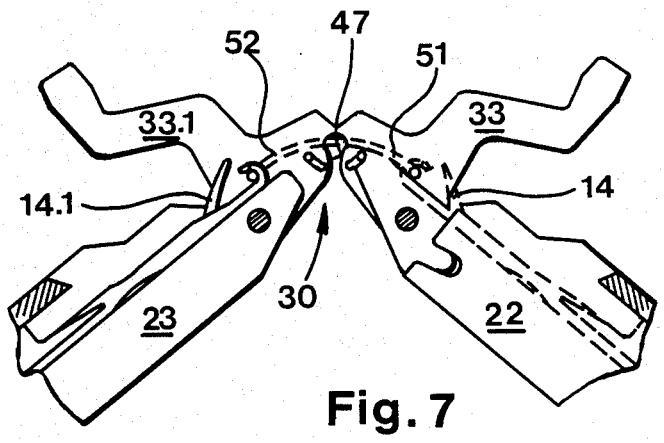

During the following retraction of the needles 21 or 21.1, the sinkers 33 and 33.1 are pivoted back, opening up the bed gap 30 before the laying in of the yarn is reached as shown in FIG. 5. Even loose old stitches 48 cannot jump up over the latches 14 and 14.1 of the needles 21 21.1, which project away from the needle shaft, but enter the gap 18' visible in FIG. 1 so that during the further retraction of the needles into the stitch-forming position visible in FIGS. 6 and 7 the latches 14 and 14.1 are reliably closed. FIG. 6 shows the retracted position in which the old stitches 48 and 48.1 slide over the closed needle head and thus press the needle latches into their fully closed position. However, the latches spring back into their stable, partly closed position after they are freed by the old stitches 48 and 48.1, in which as shown in FIG. 1 the flat region 16 of the latch 14 abuts against the spring rod 11 as visible in FIG. 7, which shows the needles in their deepest retracted position, in which new stitches 51 and 52 have been formed and hang in the partly open needle heads.

Figure 8:
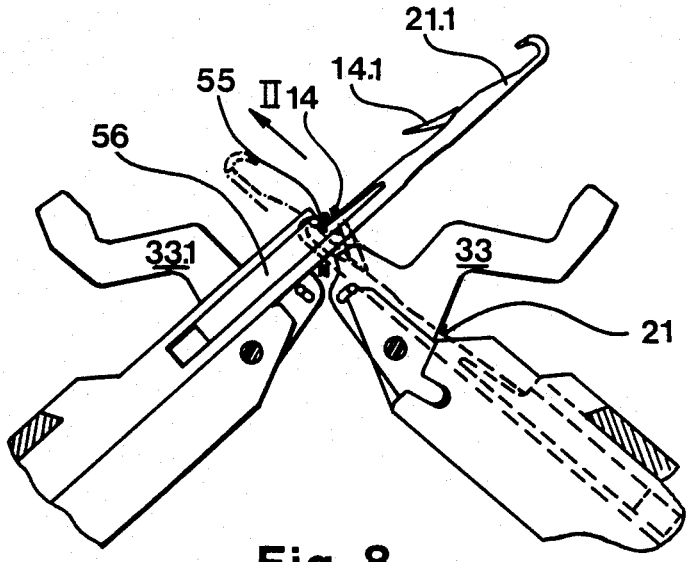

FIG. 8 shows a transfer position of the knitting elements in which the needle 21.1 takes up the position of the transfering needle and the needle 21 takes up the position of the receiving needle. The stitch 55 lying in the throat of the transfering needle 21.1 or on the hook of the receiving needle 21, and which is spread open by the needle's conventional transfer spring clip 56, moves reliably under the needle latch 14 located in a raised position during the rising movement of the needle 21 in the direction of the arrow II.

Figure 9:
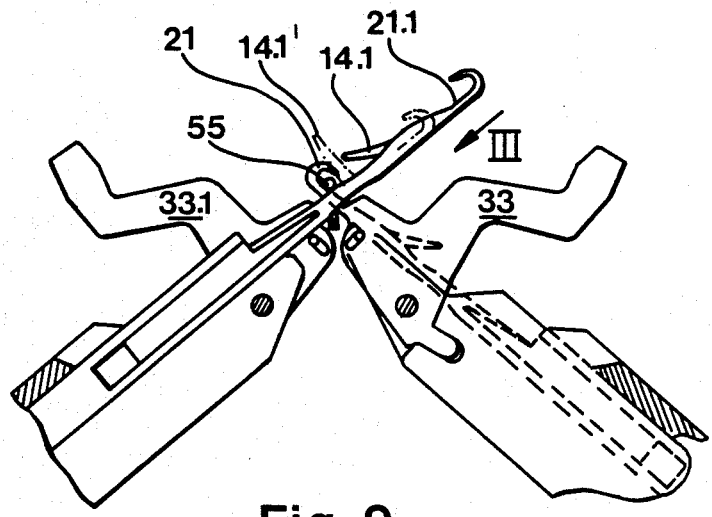

FIG. 9 shows the casting off of the stitch 55 in the transfer process. During the movement of the needle 21.1 in the direction of the arrow III, the stitch 55 lying in the hook of the needle 21 and at the same time on the shaft of the needle 21.1, executes a movement under the needle latch 14.1 and thus a guaranteed closing of the same, in order subsequently to slide off over the needle hook.

We claim:

1. A high-speed flat knitting machine comprising:

a plurality of loop transfer latch needles in a double bed separated by a bed gap, each latch needle including (a) a latch guide slot having ends, (b) a rod-shaped spring located in the latch guide slot and spanning the ends thereof, (c) an elongate latch having an end with two flat portions, (d) a pivot means for pivotally mounting the latch in the latch guide slot with the flat portion adjacent the spring such that the latch is pivotable between a first stable position which lies adjacent the fully closed position when one of the flat portions engages the spring and a second stable position which lies adjacent the fully open position when the other flat portion engages the spring and such that the latch is pressable against the spring to the fully open and fully closed positions, and (e) a transfer spring clip mounted on each of said needles for loop transfer; and a plurality of sinkers having projections which cooperate with the latch needles, the sinkers being located between the latch needles of each bed and opposite one another such that in a forward position of the sinkers the projections bridge the bed gap and serve as stitch hold-down elements.

* * * * *